US010842212B2

(12) United States Patent
Curbeon

(10) Patent No.: US 10,842,212 B2
(45) Date of Patent: Nov. 24, 2020

(54) HAIR EXTENSION

(71) Applicant: Daisy Curbeon, New York, NY (US)

(72) Inventor: Daisy Curbeon, New York, NY (US)

(73) Assignee: Daisy Curbeon, Bronx, NY (US)

( * ) Notice: Subject to any disclaimer, the term of this patent is extended or adjusted under 35 U.S.C. 154(b) by 173 days.

(21) Appl. No.: 15/955,033

(22) Filed: Apr. 17, 2018

(65) Prior Publication Data

US 2018/0228236 A1 Aug. 16, 2018

Related U.S. Application Data

(63) Continuation-in-part of application No. 14/215,424, filed on Mar. 17, 2014, now Pat. No. 9,968,150.

(51) Int. Cl.
*A41G 5/00* (2006.01)

(52) U.S. Cl.
CPC ..... *A41G 5/0053* (2013.01); *A41G 5/0073* (2013.01)

(58) Field of Classification Search
CPC ..... A41G 5/00; A41G 5/004; A41G 5/0053; A41G 5/0073
See application file for complete search history.

(56) References Cited

U.S. PATENT DOCUMENTS 3,280,826 A * 10/1966 Jenkins ..... A41G 5/004 132/201
6,830,054 B1 * 12/2004 Ross-Kuehn ..... A41G 5/0093 132/201
2005/0268930 A1 * 12/2005 Lane ..... A41G 5/004 132/128
2011/0168196 A1 * 7/2011 Freelove ..... A41G 5/0046 132/53

* cited by examiner

*Primary Examiner* — Rachel R Steitz
(74) *Attorney, Agent, or Firm* — Quinn IP Law

(57) ABSTRACT

A natural hair extension includes an elastic band. The elastic band includes an uppermost elastic ring, a middle elastic ring, a lowermost elastic ring, and a sinusoidal shaped thread attached to each of the uppermost elastic ring, the middle elastic ring, and the lowermost elastic ring. The thread is configured to keep the uppermost elastic ring, the middle elastic ring, and the lowermost elastic ring in a parallel configuration. A first plurality of hair wefts is attached to the uppermost elastic ring, and a second plurality of hair wefts is attached to the lowermost elastic ring.

9 Claims, 17 Drawing Sheets

10

HAIR EXTENSION

CROSS-REFERENCE TO RELATED APPLICATIONS

This disclosure is a continuation in part of U.S. patent application Ser. No. 14/215,424 filed on Mar. 17, 2014, which is hereby incorporated by reference.

TECHNICAL FIELD

This disclosure is related to a product utilized in hair styling. In particular, embodiments of the disclosure are directed to the field of supplemental hair fabricated from natural hair.

BACKGROUND

The statements in this section merely provide background information related to the present disclosure. Accordingly, such statements are not intended to constitute an admission of prior art.

Embodiments of the disclosure are directed to the field of hair styling. In particular, embodiments of the disclosure are directed to the field of supplemental hair fabricated from natural hair. The hair extensions of embodiments of the disclosure are adapted to be used in conjunction with a person's natural hair. The hair extensions of embodiments of the disclosure can be adapted so that the person's natural hair is blended with the hair extension. Thereby the hair extension of embodiments of the disclosure blends naturally and seamlessly with the person's natural hair.

SUMMARY

A natural hair extension includes an elastic band. The elastic band includes an uppermost elastic ring, a middle elastic ring, a lowermost elastic ring, and a sinusoidal shaped thread attached to each of the uppermost elastic ring, the middle elastic ring, and the lowermost elastic ring. The thread is configured to keep the uppermost elastic ring, the middle elastic ring, and the lowermost elastic ring in a parallel configuration. A first plurality of hair wefts is attached to the uppermost elastic ring, and a second plurality of hair wefts is attached to the lowermost elastic ring.

BRIEF DESCRIPTION OF THE DRAWINGS

One or more embodiments will now be described, by way of example, with reference to the accompanying drawings, in which.

DETAILED DESCRIPTION

Figure 1:
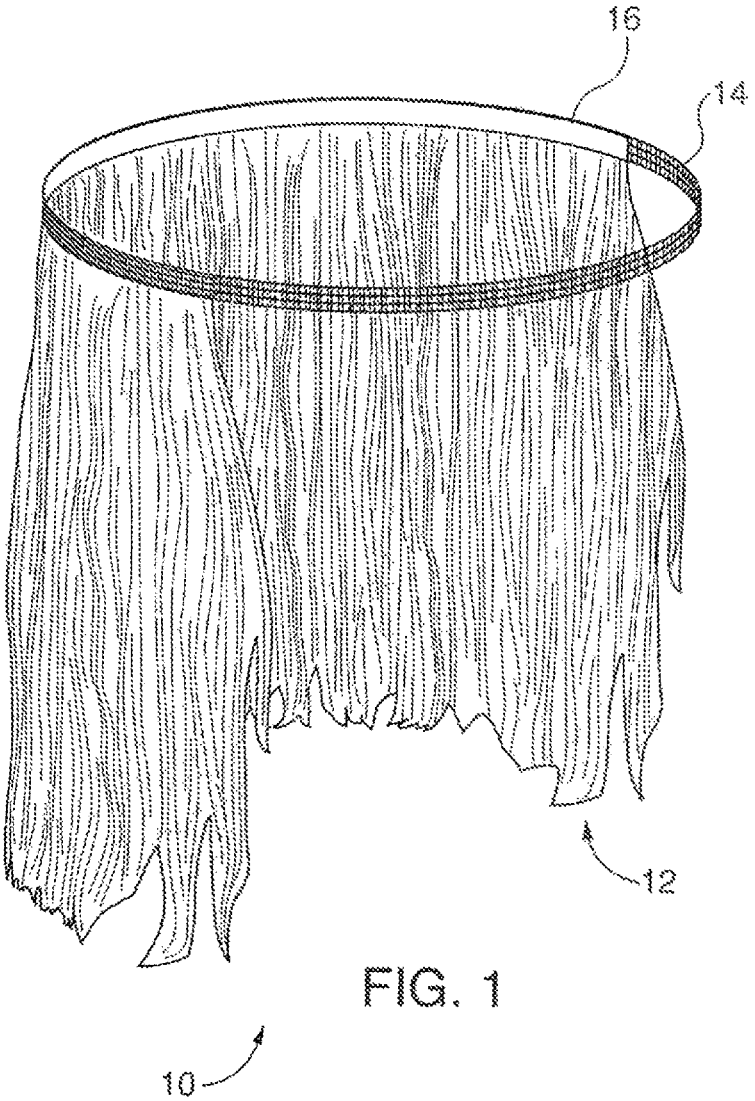
FIG. 1 is a plan view of the first embodiment of an exemplary hair styling device, in accordance with the present disclosure.

Embodiments of the disclosure will now be described in terms of the presently preferred embodiments thereof as illustrated in the drawings. Those of ordinary skill in the art will recognize that many obvious modifications may be made thereto without departing from the spirit or scope of embodiments of the disclosure.

Figure 2:
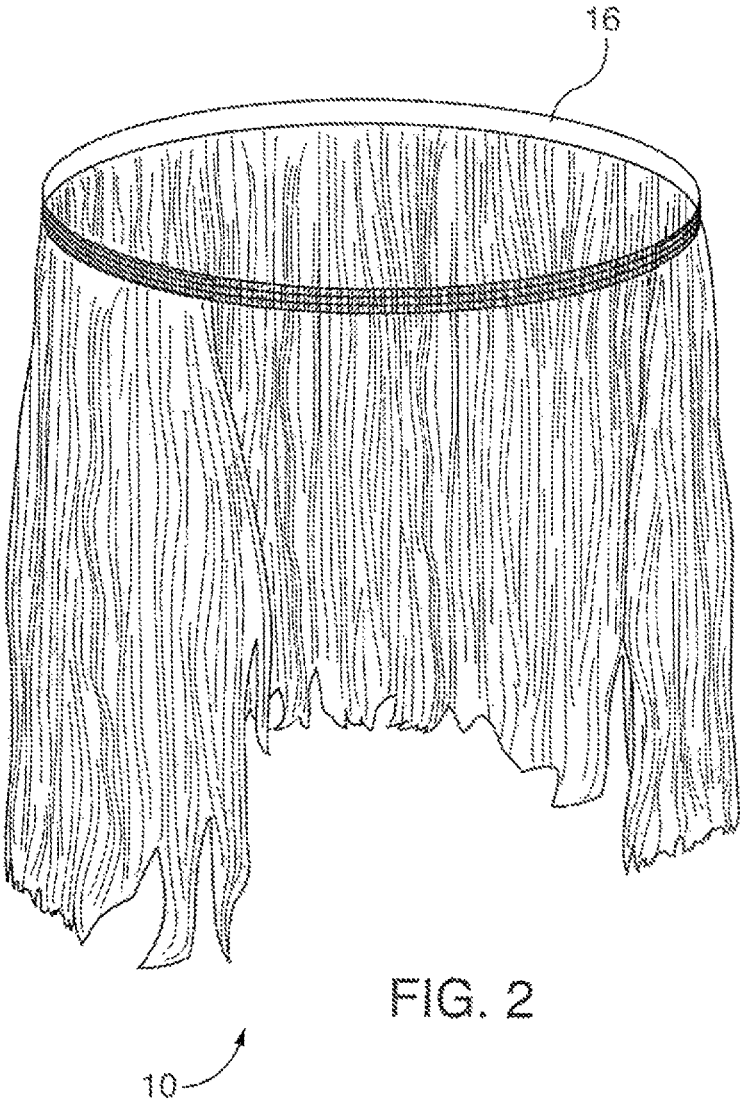
FIG. 2 is a plan view of the first embodiment of an exemplary hair styling device, in accordance with the present disclosure.

Referring now to the drawings, wherein the showings are for the purpose of illustrating certain exemplary embodiments only and not for the purpose of limiting the same, FIG. 1 illustrates a first embodiment 10 of embodiments of the disclosure which is directed to creating bangs for the user. This embodiment is made with 2 wefts 12 of natural hair. The wefts are sewn into an elastic band 14 on a zig-zag sewing machine and are sewn together using a zig-zag stitch. The wefts are very thin and flat to blend with the person's natural hair. One weft can be used for a flat extension. Alternatively, 2 to 4 wefts can be incorporated for greater fullness of the hair and more flexible designs. A ribbon 16 is placed on top of the weft and attached to the wefts by using a straight stitch at the sides, top and bottom of the ribbon. The ribbon is sewn on top of the weft to protect the person's scalp from irritation due to the foundation of the weft root and/or for those who are bald, balding, or with thin hair. The ribbon can be dyed to match the user's hair color and turned face out from the head to blend with the natural hair for those with thin hair. The elastic band 14 which comprises a mesh which can also be dyed to match the user's hair color is left open without hair at the back of the head to securely fit to the head. Thus, no clips, bobby pins, hair pins, glue or bonding or sewing to the person's natural hair are used. This elastic mesh sits on the head and scalp and fits close to the head like a glove. The ribbon is folded, the elastic mesh is sewn inside of each side as indicated above to allow for stretching and flexibility when fitting to the person's head. The elastic mesh is stretched more than usual when the ribbon is being attached for a user who is bald (as in those with cancer) or balding for comfort. FIG. 2 illustrates a different perspective view of the first embodiment 10 with a ribbon on the inside of the wefts rather than on the outside as in FIG. 1. The bangs in this embodiment 10 are approximately 18 inches in circumference around the head with an open back of approximately 6½ inches.

Figure 3:
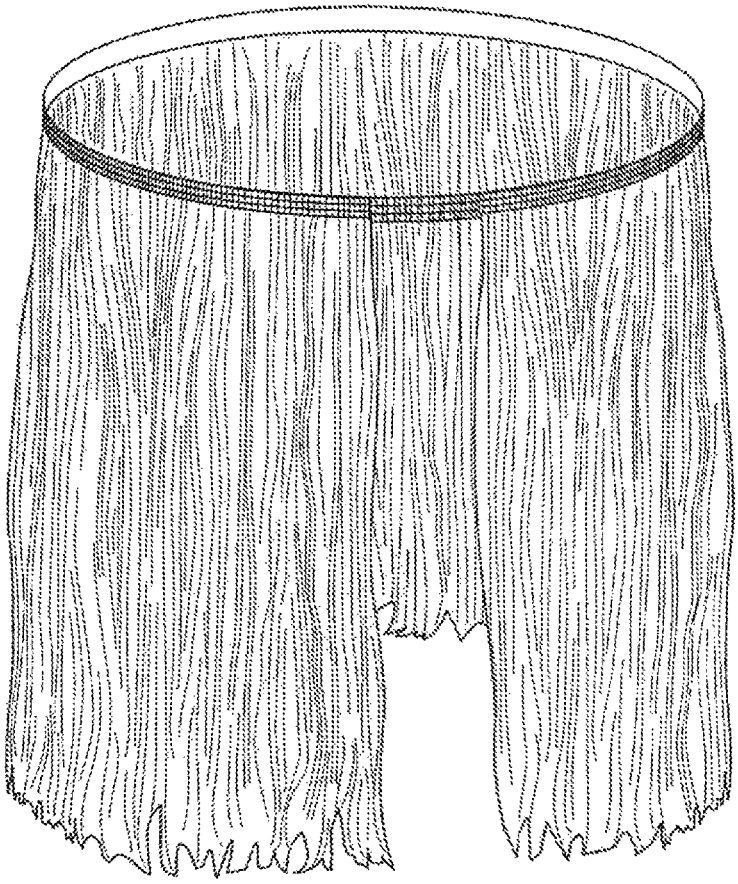
FIG. 3 is a plan view of the first embodiment of an exemplary hair styling device, in accordance with the present disclosure.

FIG. 3 illustrates the first embodiment, with an elastic mesh. FIG. 3 illustrates an approximate 2 inch opening, which allows the user to style the embodiment to create full bangs and a full set of hair on the back of the head.

Figure 4:
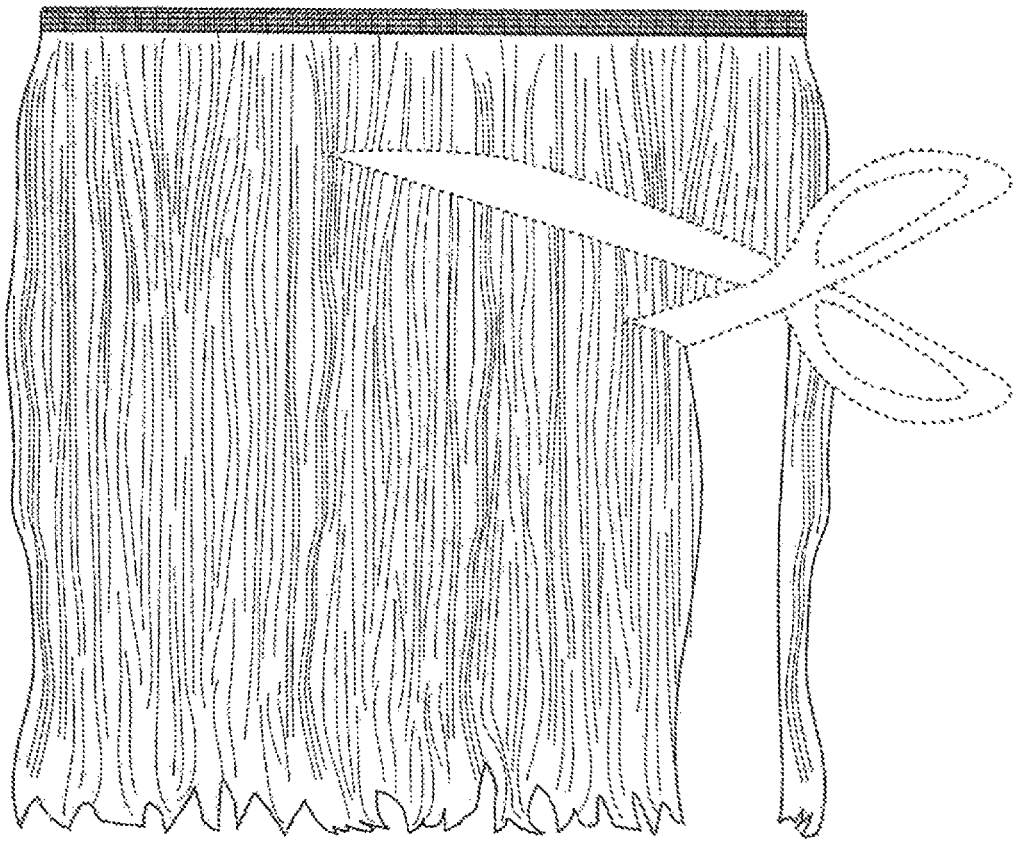
FIG. 4 is an illustration of one manner of using the hair styling device of FIG. 1, in accordance with the present disclosure.

FIG. 4 illustrates the first embodiment with the bangs cut out from the circle that is approximately 10 inches in diameter. This embodiment can be used by forming the longer hair as a ponytail with the bangs cut to a style chosen by the user.

Figure 5:
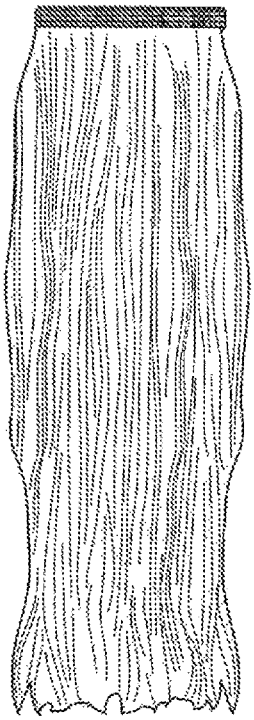
FIG. 5 is a plan view of the second embodiment of an exemplary hair styling device, in accordance with the present disclosure.
Figure 6:
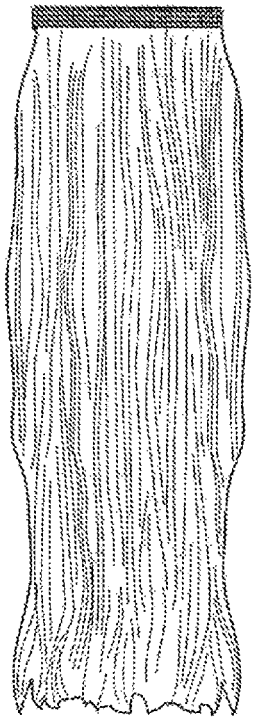
FIG. 6 is a plan view of the second embodiment of an exemplary hair styling device, in accordance with the present disclosure.

FIGS. 5 & 6 illustrate the bangs 10 in a circle with no hair in the back. This embodiment of the bangs can be used in either direction resulting in hair in the back or front depending upon the user's choice of style. This embodiment comprises the ribbon or satin sewn across the weft root to protect the scalp. If the user has thin hair and sensitive scalp, it is best to wear the ribbon towards the scalp. If the hair is strong and the scalp is not as sensitive, the weft can lay against the scalp.

Figure 7:
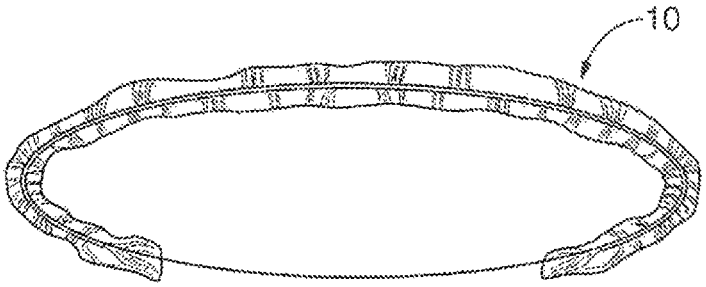
FIG. 7 is a plan view of the second embodiment of an exemplary hair styling device, in accordance with the present disclosure.

FIG. 7 shows the foundation 12 of the bangs 10 before any hair or weft is added. The foundation comprises the ribbon 16 sewn around it to protect the scalp, blend with the natural hair color and give a finished look. The ribbon and the elastic mesh are sewn together.

Figure 8:
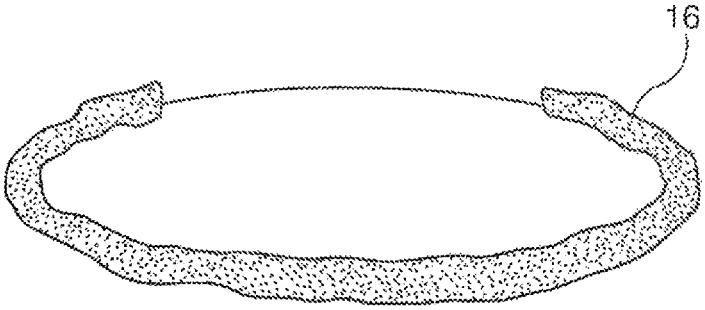
FIG. 8 is part of a second manner of use of the first embodiment of an exemplary hair styling device, in accordance with the present disclosure.

FIG. 8 illustrates the bangs in a full circle with the back cut open and the ribbon 16 sewn around the entire circumference. The ribbon 16 is folded on each side where the elastic mesh is placed and sewn therein, thus leaving approximately a 2 inch opening in the back.

Figure 9:
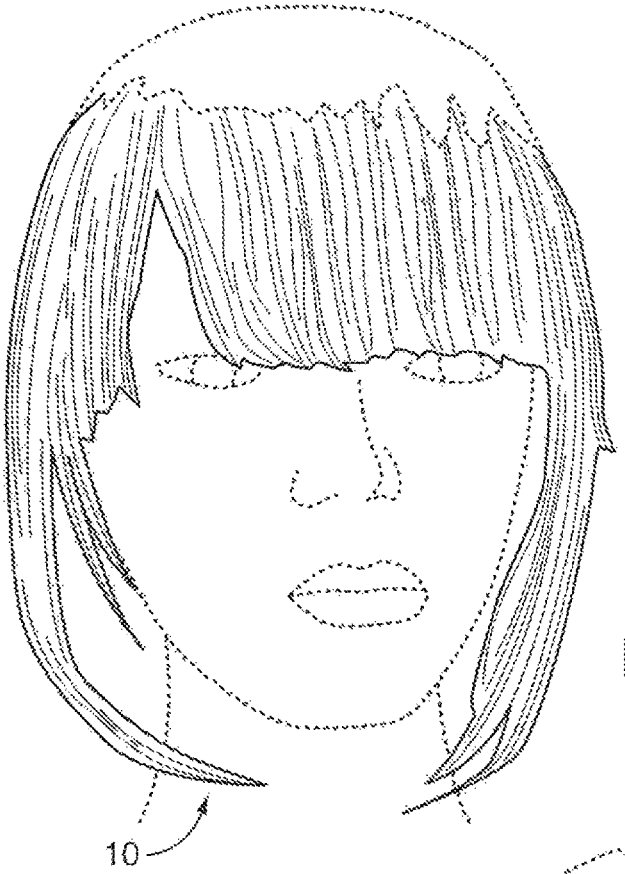
FIG. 9 illustrates a use of an exemplary hair styling device, in accordance with the present disclosure.

FIG. 9 illustrates the bangs 10 open with a ribbon inside to protect the scalp.

Figure 10:
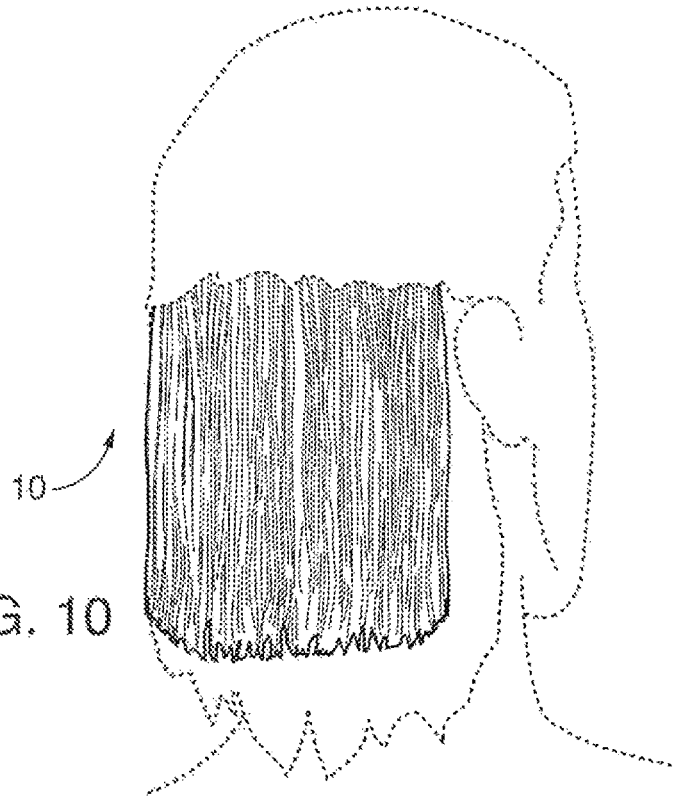
FIG. 10 illustrates a use of an exemplary hair styling device, in accordance with the present disclosure.

FIG. 10 illustrates the bangs 10 placed on the head with a full back and front around the full circumference of the head. The user's natural hair is blended into the bangs 10. This use provides a fuller and longer front and back for a user with thin hair or users who just want a different hair color mixed into their natural hair.

Figure 11:
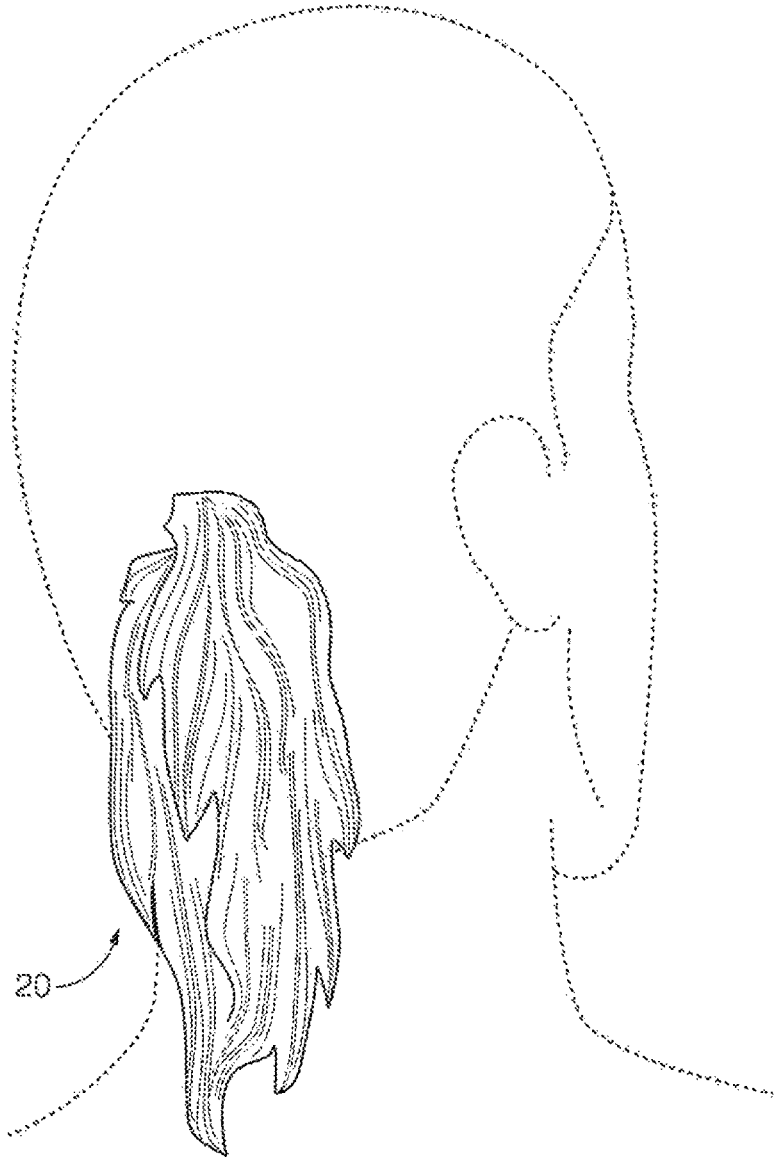
FIG. 11 illustrates a use of an exemplary hair styling device, in accordance with the present disclosure.

FIG. 11 shows the use of a second embodiment 20 referred to as a hair pineapple 20 which is fabricated with 2 wefts of natural hair. The wefts are sewn together side by side with a middle insert of elastic mesh. The first weft of natural hair is placed face down and the hair is facing outward as the elastic mesh is sewn in a zig-zag motion. The elastic mesh is pulled front and back as it is sewn together which gives it an accordion like look and feel. The second weft of natural hair is then placed on the other side of the elastic mesh and is sewn together. The hair is facing outward and the elastic mesh is in the middle. The hair is facing right and left of the elastic mesh. When the stitching is complete and it is stretched out it measures approximately 10 inches, is a circle folded over on itself and is approximately 20 inches when completely stretched. The pineapple can be used as a ponytail or used to cover the entire head to provide fullness of hair. The natural hair can be made in any color or texture and give highlights to the natural hair by blending the pineapple into the natural hair.

FIG. 11 shows the pineapple formed as a ponytail. The user takes their natural hair and pulls it up in a rubber band or elastic band. The user then takes the pineapple and turns it around the ponytail 3 times until tight and firm into the desired hairstyle. In the alternative, this embodiment, a rabbit's tail, can be created without closing the ends in a full circle and leaving it in a straight configuration. By creating this embodiment, the user with very short hair can make a small ponytail and attach one end of this embodiment with a bobby pin or hair pin and wrap it around the ponytail and attach the opposite end to the ponytail with another bobby pin or hair pin and have a longer ponytail, braided or styled as desired.

Figure 12:
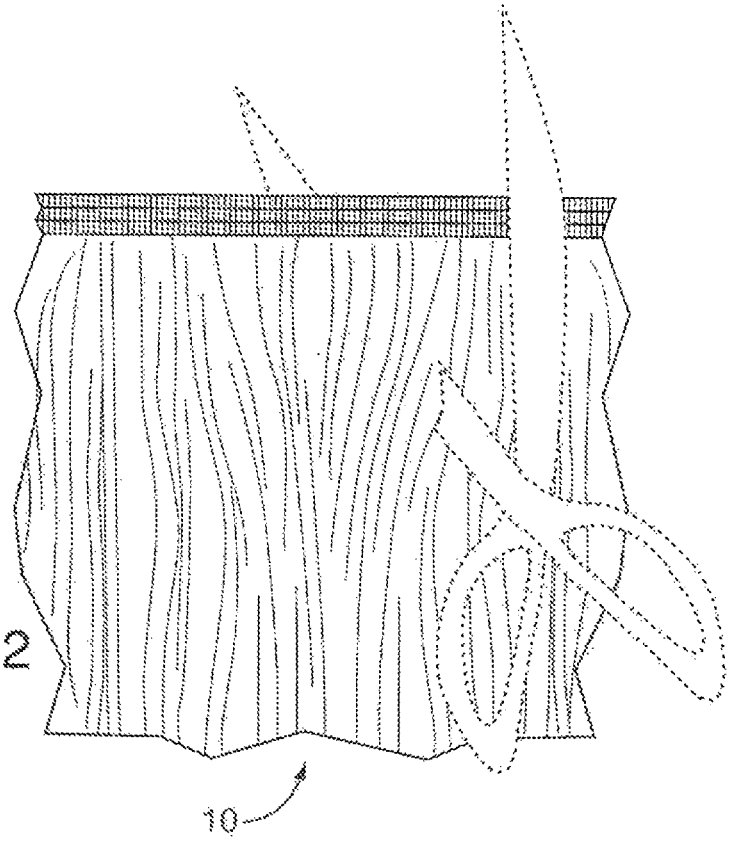
FIG. 12 illustrates a use of the second embodiment of an exemplary hair styling device, in accordance with the present disclosure.
Figure 13:
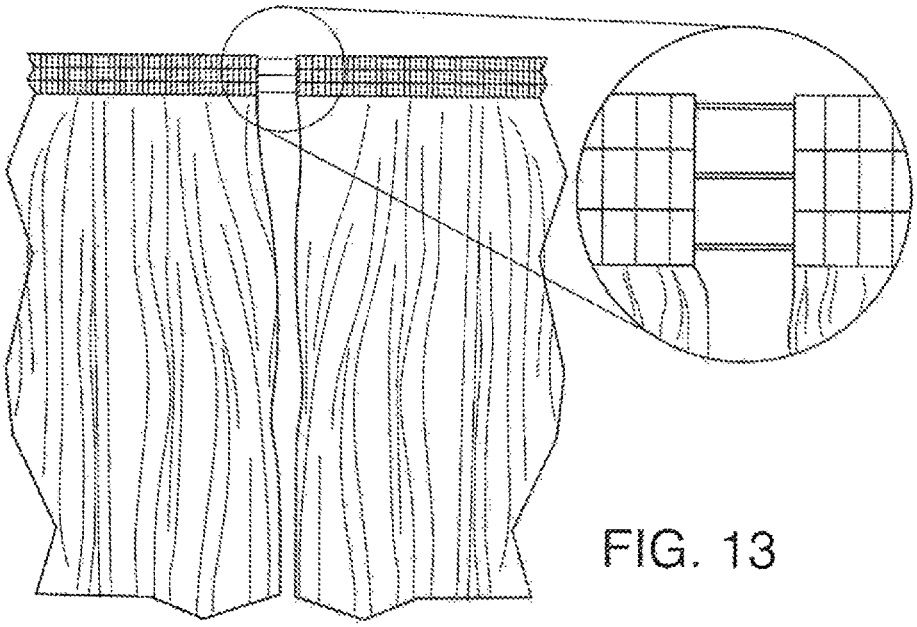
FIG. 13 is a detail view of a part of the second embodiment of an exemplary hair styling device, in accordance with the present disclosure.

FIGS. 12 & 13 illustrate an alternative embodiment with the same specifications as FIG. 1 except that the there would be a space of approximately ½ to ¼ inch where the elastic mesh would be replaced by a filament thread in three places, the wefts should not incorporated into these areas, to allow for a part in the user's natural hair. Specifically, FIG. 12 shows the bangs being cut at the root of the weft and mesh to prepare it for an open part. The creation of a part in the user's hair is illustrated in FIG. 14.

FIG. 13 more specifically illustrates the area of the weft where the bangs are cut into the root and weft creating an area for the part in the bangs. The filament thread sewn in the right and left of the wefts root into the mesh which is strong and cannot be broken by combing, brushing or pulling. The thread is sewn into the root of the weft with a straight stitch and the thread is wrapped around the needle and pulled. This is called a double stitch. This filament thread allow the client with a natural middle part or left, right part the freedom to style the hair with a middle, left and right part. FIG. 13 further illustrates 3 pieces of filament thread across the wefts sewn inside the root and foundation. If the client has 2 wefts then 2 filament threads will be attached by sewing the thread to the wefts at the mesh on each side. If 1 weft is used, 1 filament thread is attached, if 2 wefts are used, 2 threads are used and if 3 wefts are used, 3 threads are used for stabilization. The filament thread is clear and invisible and will not be seen in the scalp because the natural hair will blend into the thread. The filament thread is available in different colors and thickness should the user determine color would be a more appropriate choice for blending with the hair.

FIG. 12 illustrates the bangs 10 in a circle which will go around the entire head of the user. In this use, the bangs are cut as bangs with a piece of the circumference having natural hair for the back of the head. FIG. 13 is the same as FIG. 12 with the outside of the ribbon to cover the weft root. The elastic mesh is dyed to match the hair color.

Figure 14:
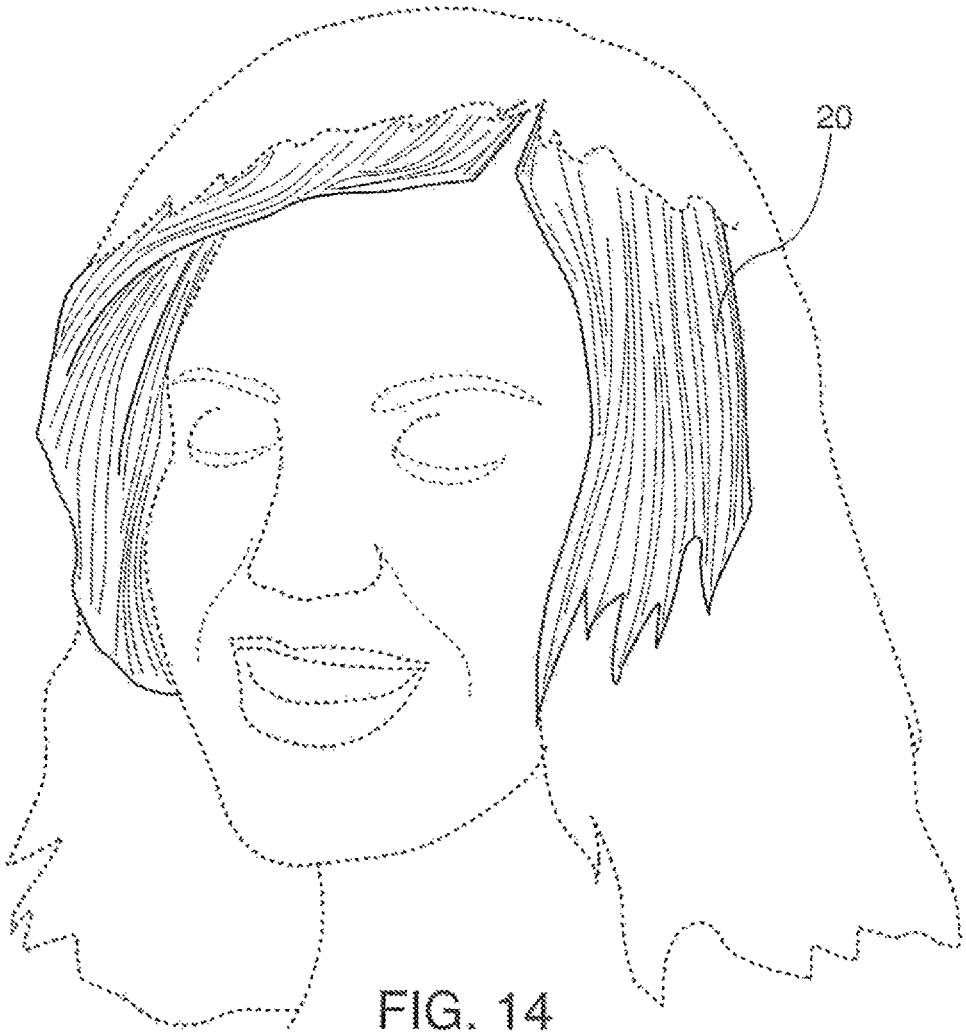
FIG. 14 illustrates a use of the second embodiment of an exemplary hair styling device, in accordance with the present disclosure.

FIG. 14 shows the pineapple 20 made in an approximate 20 inch circle covering the entire head where the user's natural hair line will lay. The pineapple can also be combed over the hair line to cover the roots of the user's hair and the foundation of the pineapple. The crown of the hair blended into the pineapple and around the back of the head. In this way, the pineapple can be combed, cut and blended into the natural hair. The bangs 10 can also be styled with a part as in FIG. 14.

Figure 15:
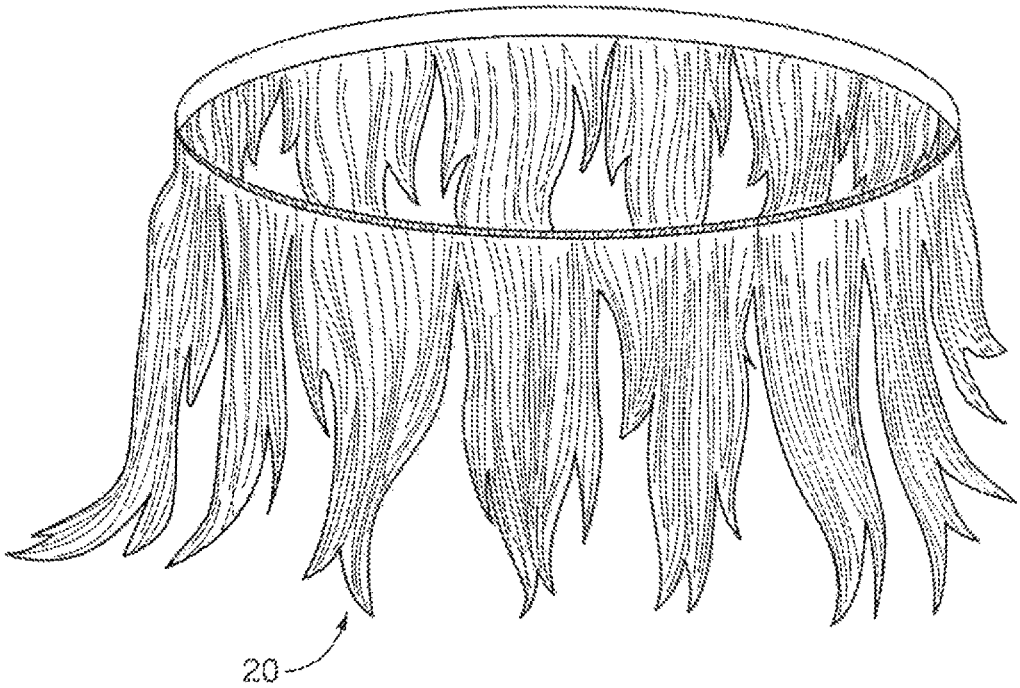
FIG. 15 illustrates a third embodiment of an exemplary hair styling device, in accordance with the present disclosure.

FIG. 15 illustrates the pineapple 20 in a full circle of approximately a 20 inch circumference to go around the entire head. This variation comprises elastic mesh sewn with a weft track being held tightly in the left hand and pulled to stretch it with the right hand while sewing with a zig-zag stitch.

Figure 16:
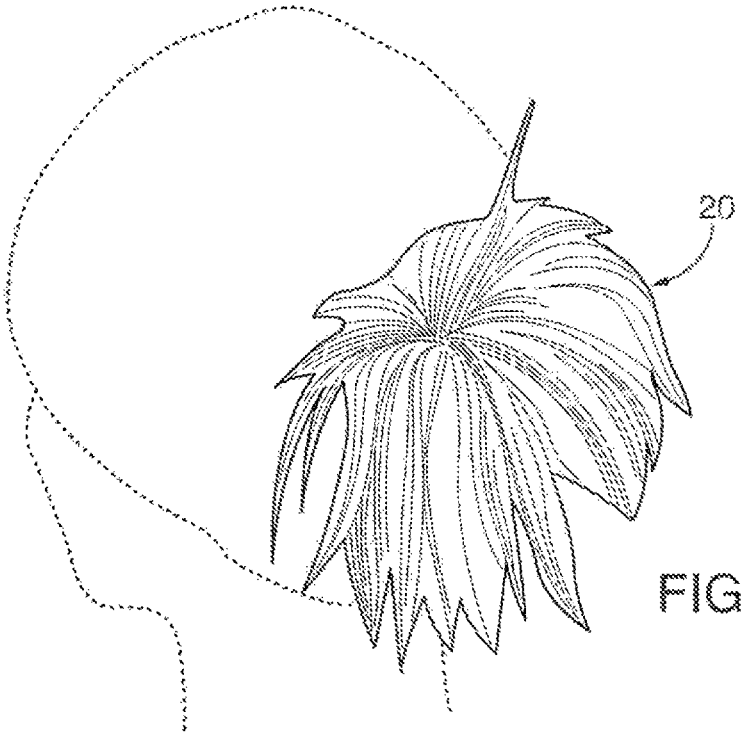
FIG. 16 illustrates a use of the third embodiment of an exemplary hair styling device, in accordance with the present disclosure.

FIG. 16 shows the pineapple 20 formed with a ponytail that can be of various sizes or circumference.

Figure 17:
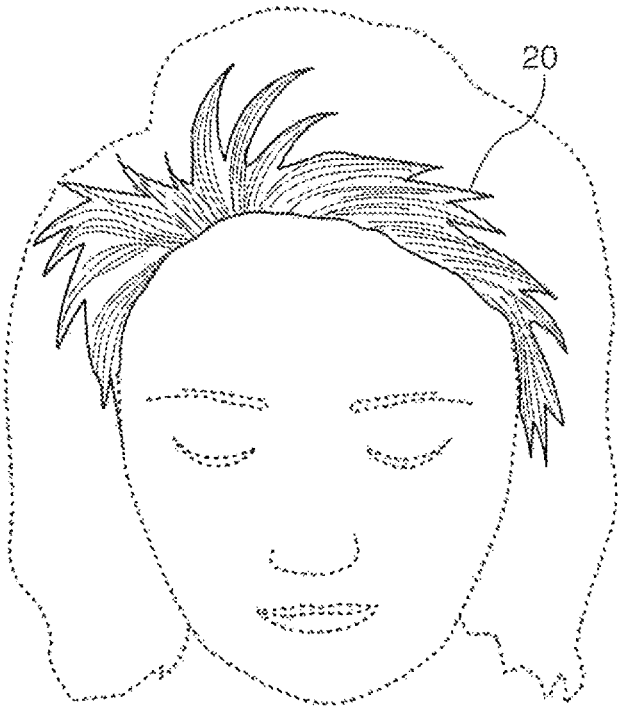
FIG. 17 illustrates a use of the third embodiment of an exemplary hair styling device, in accordance with the present disclosure.

FIG. 17 shows the pineapple 20 that can be used to cover the entire head. The user's natural hair line covers the root of the pineapple or the root of the pineapple can be visible. This pineapple covers the entire front and back of the head. The pineapple around the entire head is used to style the user's natural hair and cover the weft roots of the pineapple.

Figure 18:
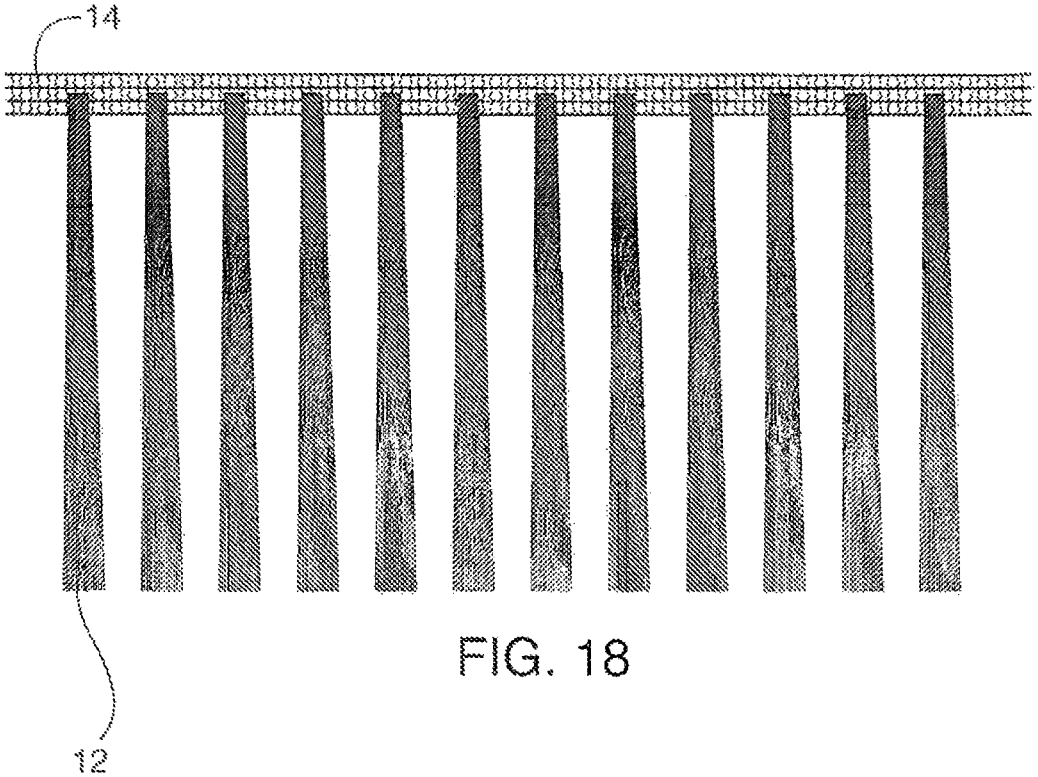
FIG. 18 illustrates a manner of fabricating the third embodiment of an exemplary hair styling device, in accordance with the present disclosure.

FIG. 18 illustrates the elastic mesh fabricated with hair ventilated techniques used. All of the above designs can be made with this technique and/or with a weft track. FIG. 18 illustrates the elastic mesh formed with the hair by a needle and tied with a fisherman's knot.

Figure 19:
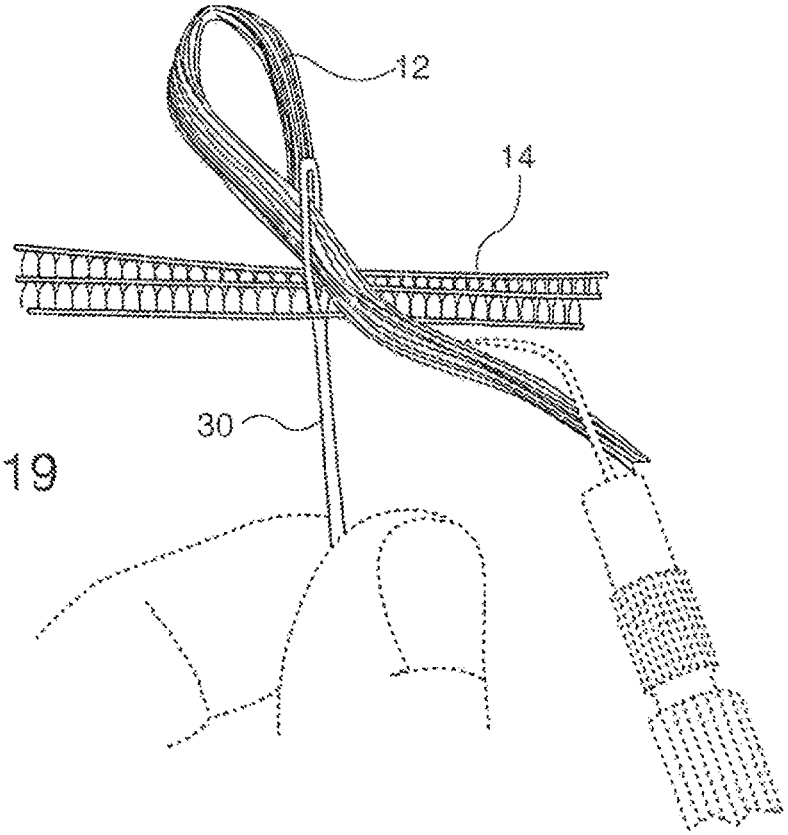
FIG. 19 illustrates a manner of fabricating the third embodiment of an exemplary hair styling device, in accordance with the present disclosure.

FIG. 19 illustrates how the natural hair 12 is attached to the elastic mesh 14 with a needle/ventilating needle 20. The hair is inserted through the eye of the needle and inserted into the elastic mesh, pulled through the mesh and knotted 2-3 times and pulled until the hair is flat.

Figure 20:
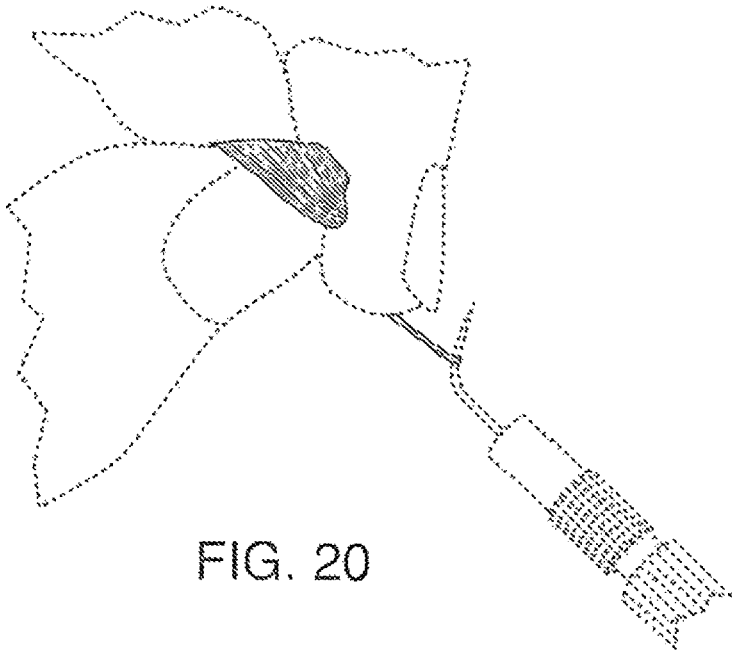
FIG. 20 illustrates a manner of fabricating the third embodiment of an exemplary hair styling device, in accordance with the present disclosure.

FIG. 20 illustrates a needle hooked into the hair. One hand holds the hair tight and then by turning the other hand 2-3 times results in the needle turning inside the elastic mesh. The needle is then pulled until the hair is straight and tight resulting in very small knots. This is done until the entire bang, ponytail and/or rabbit's tail is done.

Figure 21:
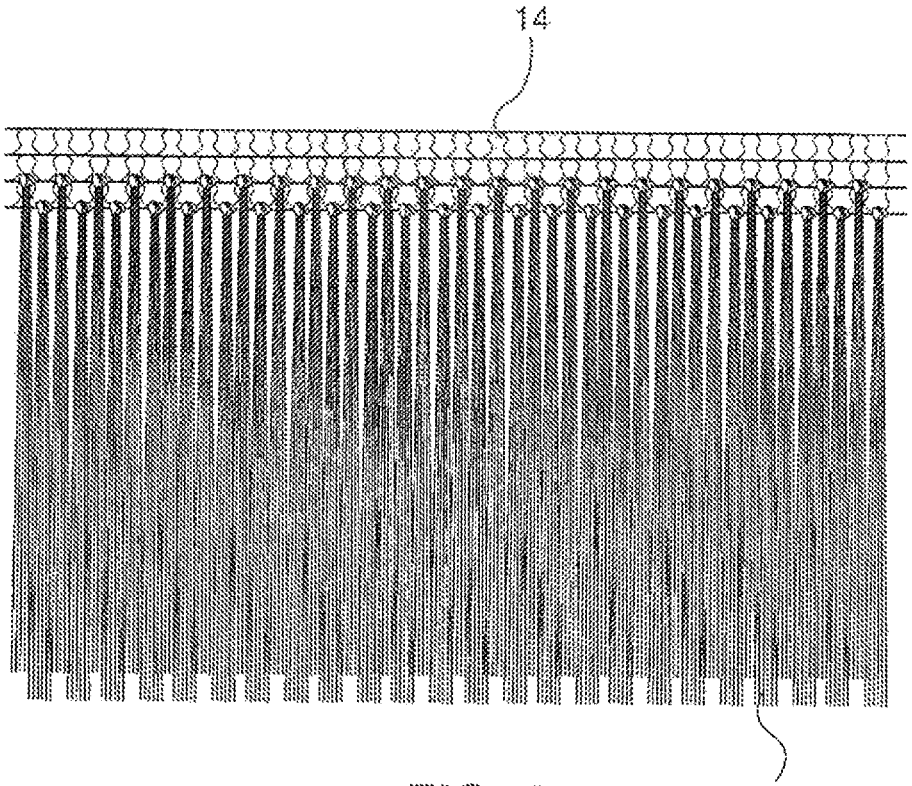
FIG. 21 illustrates a fourth embodiment of embodiments of the disclosure of an exemplary hair styling device, in accordance with the present disclosure.

FIG. 21 illustrates an alternate embodiment where the elastic mesh 14 with the ventilating and needle work is done with hair 12 on the entire elastic mesh. This embodiment can be used as a bang design from ear to ear or in an entire circle front to back with a 1 inch opening and can be used to fabricate the pineapple as well.

Figure 22:
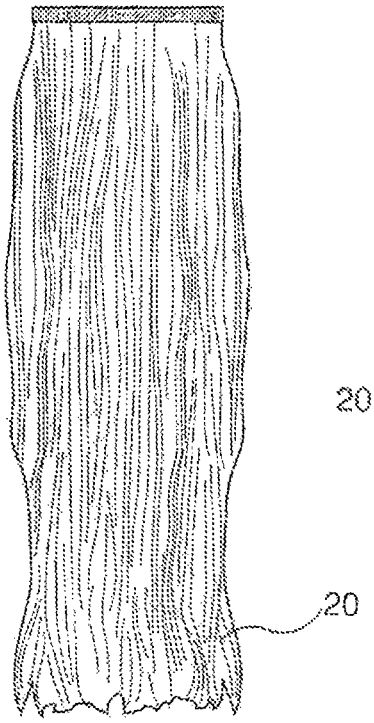
FIG. 22 is a plan view of the second embodiment of an exemplary hair styling device, in accordance with the present disclosure.
Figure 23:
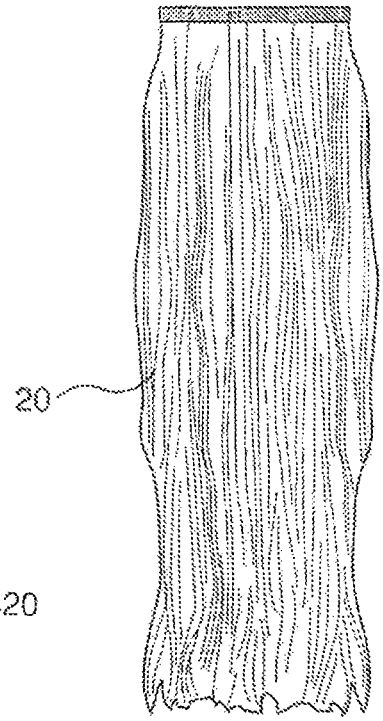
FIG. 23 is a plan view of a second embodiment of an exemplary hair styling device, in accordance with the present disclosure.

FIGS. 22 and 23 illustrate views of the small circle for the pineapple (20) with elastic mesh on the entire circle sewn with the weft or ventilating or needle technique. This embodiment can also be formed in the same manner illustrated in FIGS. 12 and 13 to create a part in the user's natural hair.

Figure 24:
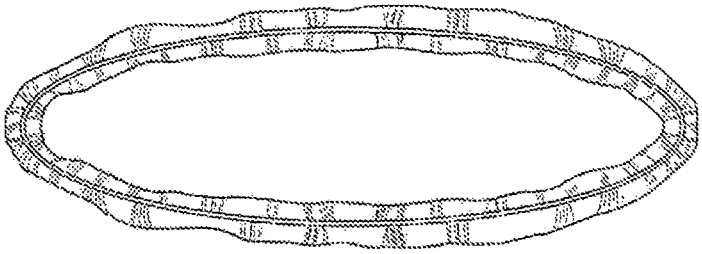
FIG. 24 is a plan view of a part of the second embodiment of an exemplary hair styling device, in accordance with the present disclosure.

FIG. 24 shows a full circle with the elastic mesh in full circle. This can be used as the foundation of the ponytail and will attach to the foundation of FIG. 21 and will have an elastic mesh to create a ponytail that can be pulled and stretched.

Figure 25:
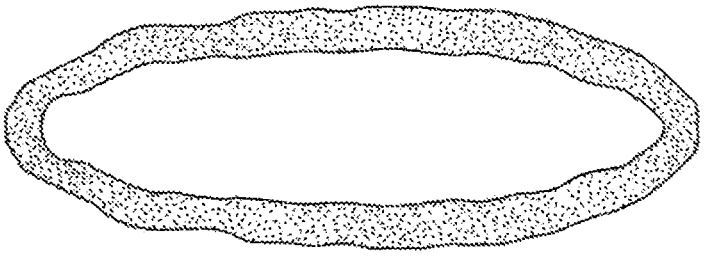
FIG. 25 is an illustration of part of the second embodiment of an exemplary hair styling device, in accordance with the present disclosure.

FIG. 25 illustrates the back of the elastic mesh for the embodiment shown in FIGS. 22 and 23 which is the foundation of the ponytail and the back of the root of the design that allows the natural hair to be covered.

Figure 26:
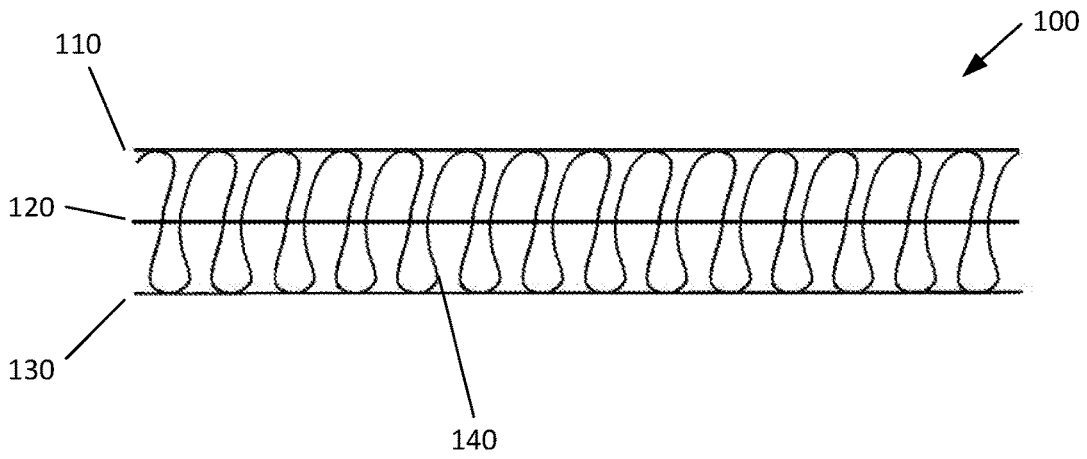
FIG. 26 illustrates a section of an alternative embodiment of the elastic band of FIG. 1, the embodiment including three elastic rings oriented horizontally, with a sinusoidal shaped monofilament thread adjoining and aligning the three elastic rings into the elastic band, in accordance with the present disclosure.

FIG. 26 illustrates a section of an alternative embodiment of the elastic band of FIG. 1, the embodiment including three elastic rings oriented horizontally, with a sinusoidal shaped monofilament thread adjoining and aligning the three elastic rings into the elastic band. Elastic band 100 is illustrated including uppermost elastic ring 110, middle elastic ring 120, and lowermost elastic ring 130. Rings 110, 120, and 130 can each form circles, such that the band forms a continuous circle which can be stretched over the head of the wearer or wrapped in loops around a pony tail in the hair of the wearer. Sinusoidal shaped monofilament thread 140 is illustrated looping back and forth between uppermost elastic ring 110 and the lowermost elastic ring 130. Thread 140 can be attached to each of uppermost elastic ring 110, middle elastic ring 120, and lowermost elastic ring 130 at each point of intersection. Rings 110, 120, and 130 are elastic and can easily be stretched. Thread 140 resists being stretched and is useful to keep rings 110, 120, and 130 substantially equally spaced from each other while still permitting the rings 110, 120, and 130 to stretch. Sinusoidal shaped monofilament thread 140 can include a polymerized monofilament cord. Thread 140 can be substituted with any thread that is configured to substantially be inelastic and hold the elastic rings in a substantially parallel configuration.

Figure 27:
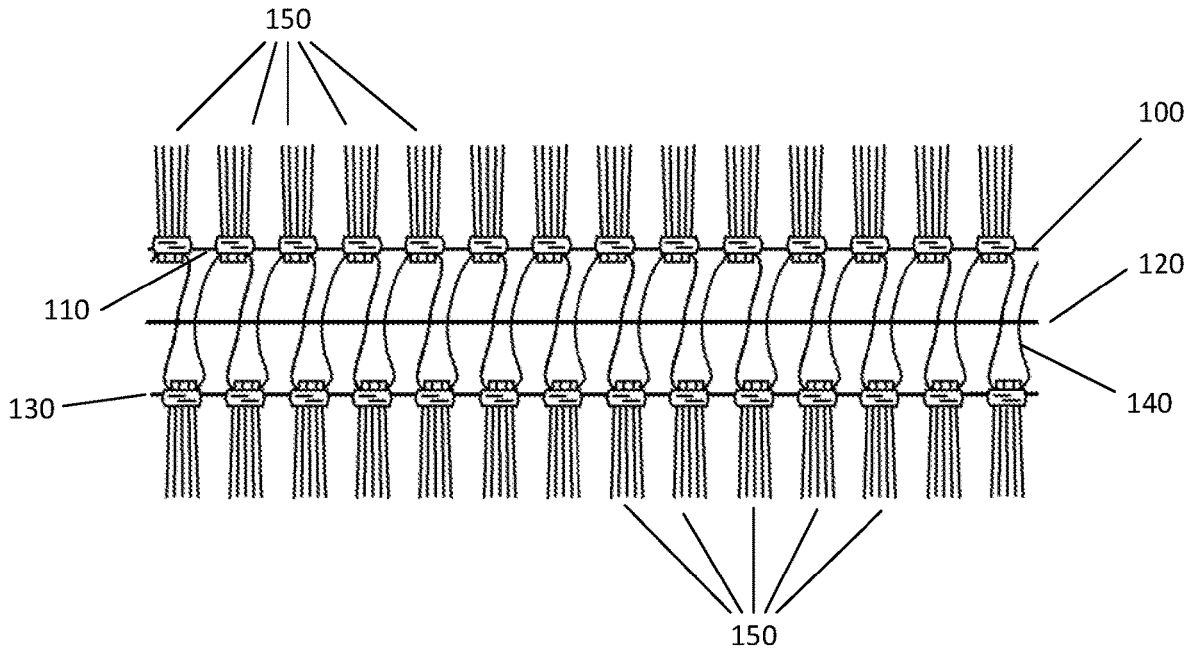
FIG. 27 illustrates the section of the elastic band of FIG. 26, with wefts of hair woven upon an uppermost of the three elastic rings and a lowermost of the three elastic rings, in accordance with the present disclosure.

FIG. 27 illustrates the section of the elastic band of FIG. 26, with wefts of hair woven upon an uppermost of the three elastic rings and a lowermost of the three elastic rings. A plurality of wefts 150 of hair are illustrated attached to the uppermost elastic ring 110 and lowermost elastic ring 130 of elastic band 100. In the exemplary embodiment of FIG. 27, wefts 150 are attached at every intersection of monofilament thread 140 and uppermost elastic ring 110 and lowermost elastic ring 130.

Figure 29:
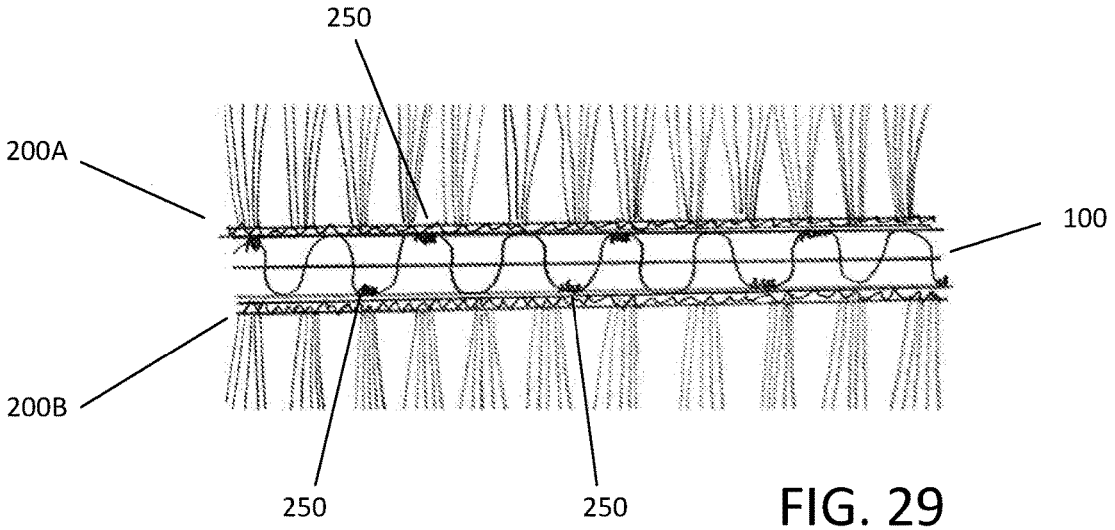
FIG. 29 illustrates an exemplary alternative embodiment of an exemplary hair styling device including two of the hair weft carrier ribbons of FIG. 28 located next to the elastic band of FIG. 26, with periodic connections attaching each hair weft carrier ribbon to one of the uppermost elastic ring and the lowermost elastic ring, in accordance with the present disclosure.

Thread 140 of elastic band 100 deforms as elastic band 100 is stretched. FIG. 29 illustrates an exemplary elastic band 100 in a stretched state. As elastic band 100 of FIG. 27 is pulled into a stretched state, holes between thread 140 and the elastic rings 110, 120, and 130 expand. If the elastic band 100 is placed close to the hair of the wearer in this expanded state and then the elastic band is allowed to contract into a relaxed state as illustrated in FIG. 27, the holes between thread 140 and the elastic rings contract and grip to the hair of the wearer. If wefts 150 were attached to middle elastic ring 120, the wefts 150 would interfere with the hair of the user being gripped by the contracting holes between thread 140 and the elastic rings. By attaching wefts 150 to uppermost elastic ring 110 and lowermost elastic ring 130, a dense pattern of hair can be provided by wefts 150, and by not attaching wefts 150 to middle elastic ring 120, the elastic band 100 can grip to the hair of the wearer.

Figure 28:
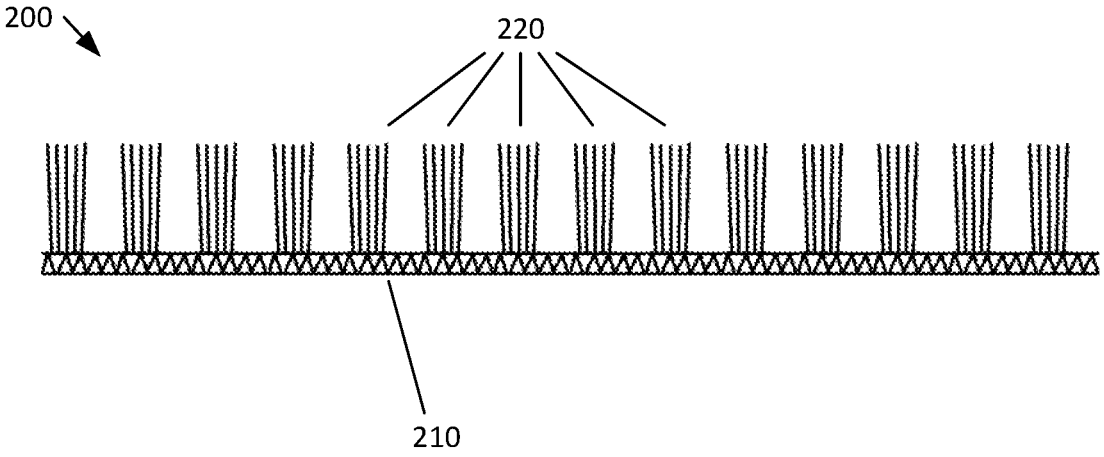
FIG. 28 illustrates an exemplary hair weft carrier ribbon, including a base ribbon portion and a plurality of wefts of hair extending from the base ribbon portion, in accordance with the present disclosure.

FIG. 28 illustrates an exemplary hair weft carrier ribbon, including a base ribbon portion and a plurality of wefts of hair extending from the base ribbon portion. In an alternative to attaching wefts of hair directly to an elastic band, a hair weft carrier ribbon 200 can be attached to an elastic band. Such a ribbon 200 can be manufactured more easily than attaching individual wefts to an elastic band, and ribbon 200 provides improved structure to the attached wefts 220, thereby providing a more even presentation of hair upon the wearer. Hair weft carrier ribbon 200 includes base ribbon portion 210 including a woven cloth ribbon and a cross-stitch treat pattern attaching wefts 220 to the cloth ribbon. A number of different constructions to make similar hair weft carrier ribbons are envisioned, and the disclosure is not intended to be limited to the particular example provided herein.

FIG. 29 illustrates an exemplary alternative embodiment of an exemplary hair styling device including two of the hair weft carrier ribbons of FIG. 28 located next to the elastic band of FIG. 26, with periodic connections attaching each hair weft carrier ribbon to one of the uppermost elastic ring and the lowermost elastic ring. Elastic band 100 is illustrated in a stretched state, with elastic rings of elastic band 100 elastically deformed horizontally. Hair weft carrier ribbons 200A and 200B are illustrated attached to elastic band 100 with periodic connections 250, each carrier ribbon 200A and 200B a copy of hair weft carrier ribbon 200 of FIG. 28. By connecting ribbons 200A and 200B to elastic band 100 such that ribbons 200A and 200B are parallel to the elastic rings of elastic band 100 when elastic band 100 is in a stretched state, ribbons 200A and 200B deform into a wavy state when the elastic band 100 is permitted to contract into a relaxed state.

Figure 30:
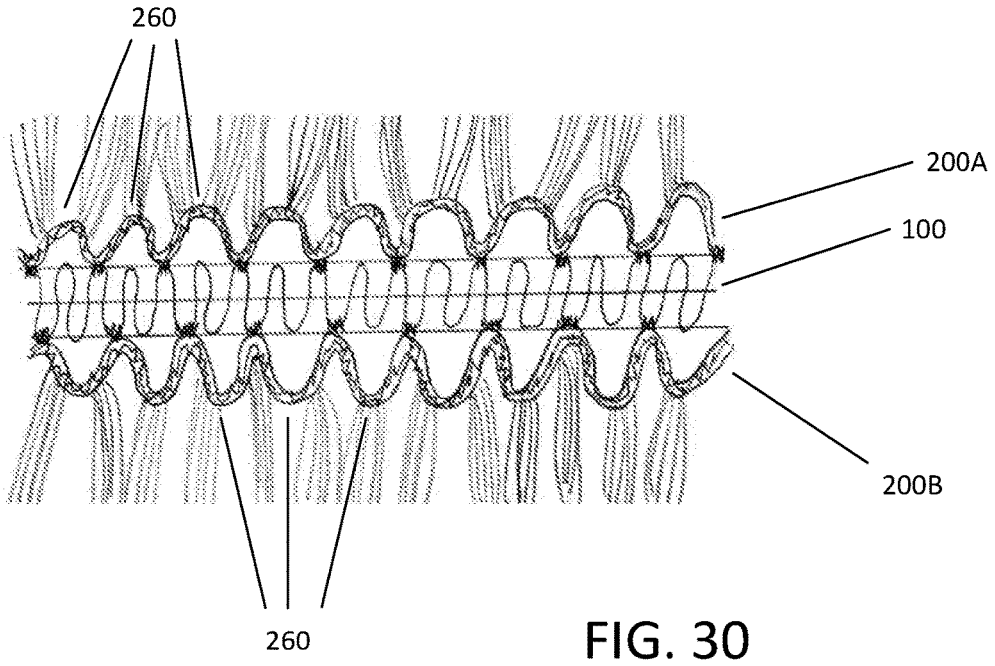
FIG. 30 illustrates an exemplary embodiment of the hair styling device of FIG. 29, wherein the hair styling device as illustrated in FIG. 29 was in a stretched out state, and wherein the hair styling device as illustrated in FIG. 30 is in a relaxed state, with the hair weft carrier ribbons being folded into a wavy condition as a result of the relaxed state, in accordance with the present disclosure.

FIG. 30 illustrates an exemplary embodiment of the hair styling device of FIG. 29, wherein the hair styling device as illustrated in FIG. 29 was in a stretched out state, and wherein the hair styling device as illustrated in FIG. 30 is in a relaxed state, with the hair weft carrier ribbons being folded into a wavy condition as a result of the relaxed state. Elastic band 100 is illustrated in a relaxed state. Because the connections attaching carrier ribbon 200A and 200B are pulled closer together by the contraction of elastic band 100, waves 260 are formed in each carrier ribbons 200A and 200B. These waves 260 create a dense hair pattern in the attached wefts, thereby enhancing the appearance of the hair upon the wearer.

The embodiments described in FIGS. 26-30 can include hair wefts extending entirely around the elastic band as shown in FIG. 15. In other examples, the embodiment described in FIGS. 26-30 can include hair wefts extending around only a portion of the elastic band as shown in FIGS. 1 and 2.

The embodiments of FIGS. 26-30 can be formed into an elastic band formed into a circle. In another embodiment, as illustrated in FIG. 18, an elastic band can simply be an elastic cord with two unconnected ends. The band can be formed as a strand or a circular elastic band can be cut. Such an elastic band cord, improved as illustrated in FIGS. 26-30, can be used in a number of ways, for example, wrapping around a ponytail of a user to provide a desired visual effect. In such an embodiment where the elastic band is a straight elastic cord, the uppermost, middle, and lowermost rings described in FIGS. 26-30 can alternatively be described as uppermost, middle, and lowermost elastic strands.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A natural hair extension comprising:

an annular elastic band comprising:

an uppermost elastic ring;

a middle elastic ring;

a lowermost elastic ring, wherein the uppermost elastic ring, the middle elastic ring, and the lowermost elastic ring are arranged in a parallel configuration; and a sinusoidal shaped thread attached to each of the uppermost elastic ring, the middle elastic ring, and the lowermost elastic ring and configured to keep the uppermost elastic ring, the middle elastic ring, and the lowermost elastic ring in the parallel configuration;

a first plurality of hair wefts attached to and extending in a first perpendicular direction from the uppermost elastic ring; and a second plurality of hair wefts attached to and extending in a second perpendicular direction from the lowermost elastic ring.

2. The natural hair extension of claim 1, wherein the sinusoidal shaped thread comprises a polymerized monofilament thread.

3. The natural hair extension of claim 1, wherein the first plurality of hair wefts comprise a first hair weft carrier ribbon comprising the first plurality of hair wefts attached to a first ribbon; and wherein the second plurality of hair wefts comprise a second hair weft carrier ribbon comprising the second plurality of hair wefts attached to a second ribbon.

4. The natural hair extension of claim 3, wherein the first hair weft carrier ribbon is periodically attached to the uppermost elastic ring; and wherein the second hair weft carrier ribbon is periodically attached to the lowermost elastic ring.

5. The natural hair extension of claim 4, wherein the first hair weft carrier ribbon comprises waves when the elastic band is in a relaxed state.

6. The natural hair extension of claim 4, wherein the first hair weft carrier ribbon is parallel with the uppermost elastic ring when the elastic band is in a stretched state.

7. The natural hair extension of claim 1, wherein the first plurality of hair wefts and the second plurality of hair wefts each extend along an entire length of the elastic band.

8. The natural hair extension of claim 1, wherein the first plurality of hair wefts and the second plurality of hair wefts each extend along a portion of an entire length of the elastic band.

9. A natural hair extension comprising:

an annular elastic band comprising:

an uppermost elastic strand;

a middle elastic strand;

a lowermost elastic strand, wherein the uppermost elastic strand, the middle elastic strand, and the lowermost elastic strand are arranged in a parallel configuration; and a sinusoidal shaped thread attached to each of the uppermost elastic strand, the middle elastic strand, and the lowermost elastic strand and configured to keep the uppermost elastic strand, the middle elastic strand, and the lowermost elastic strand in the parallel configuration;

a first plurality of hair wefts attached to and extending in a first perpendicular direction from the uppermost elastic strand; and a second plurality of hair wefts attached to and extending in a second perpendicular direction from the lowermost elastic strand.

* * * * *